US006542576B2

(12) United States Patent
Mattson

(10) Patent No.: US 6,542,576 B2
(45) Date of Patent: Apr. 1, 2003

(54) X-RAY TUBE FOR CT APPLICATIONS

(75) Inventor: Rodney A. Mattson, Mentor, OH (US)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 09/766,777

(22) Filed: Jan. 22, 2001

(65) Prior Publication Data

US 2002/0106056 A1 Aug. 8, 2002

(51) Int. Cl.[7] ..... H01J 35/00
(52) U.S. Cl. ..... 378/119; 378/145; 378/156
(58) Field of Search ..... 378/119, 125, 378/4, 16, 121, 140, 144, 147, 145, 156

(56) References Cited

U.S. PATENT DOCUMENTS 3,113,233 A * 12/1963 Kasten, Jr. et al. ..... 313/60
4,166,231 A * 8/1979 Braun ..... 313/60
4,217,517 A 8/1980 Delair et al.
4,461,019 A * 7/1984 Lersmacher ..... 378/125
4,827,494 A * 5/1989 Koenigsberg ..... 378/138
4,905,268 A * 2/1990 Mattson et al. ..... 378/158
5,268,955 A * 12/1993 Burke et al. ..... 378/135
5,745,548 A * 4/1998 Dobbs et al. ..... 378/207
5,757,951 A * 5/1998 Tuy ..... 382/131
6,052,434 A * 4/2000 Toth et al. ..... 378/143
6,163,593 A 12/2000 Koller et al.

FOREIGN PATENT DOCUMENTS

JP 03194834 8/1991

* cited by examiner

*Primary Examiner*—Drew A. Dunn
*Assistant Examiner*—Jurie Yun
(74) *Attorney, Agent, or Firm*—Fay, Sharpe, Fagan, Minnich & McKee, LLP

(57) ABSTRACT

An x-ray tube assembly (16) includes a vacuum envelope (52) and an x-ray permeable exit window (58). An anode (50) is positioned within the vacuum envelope (52) such that a near side is adjacent to the exit window (58) and a far side is opposite thereof. A cathode assembly (66) is also mounted within the vacuum envelope (52) which directs an electron beam (72) toward a focal spot or point (62) on the far side of the anode (50). The anode further includes a central cavity or indentation (70) which provides a location for mounting a set of radiation attenuating vanes (64) in addition to a shaped x-ray filter or compensator (68). Close placement of the vanes (64) and the filter (68) relative to the focal spot of the anode desirably reduce off focal radiation and allow beam shaping. An externally located collimator (18) further shapes the output x-ray beam.

20 Claims, 3 Drawing Sheets

X-RAY TUBE FOR CT APPLICATIONS

BACKGROUND OF THE INVENTION

The present application relates to the x-ray tube arts. The invention finds particular application in x-ray tube assemblies for large bore computed tomography scanners. It is to be appreciated, that the present invention finds further application in other x-ray devices where it is desirable to incorporate beam shapers and off-focal radiation vanes into the x-ray tube assembly itself and in those where a wider scan area is desirable while maintaining overall device size.

Some computed tomography (CT) scanning applications require a large opening in the center of the gantry A central bore with a diameter of 85–95 cm provides flexibility in the placement of a patient within the gantry. The diameter of the reconstruction field of view (FOV) may be increased to 60 cm or greater. CT gantries used current in medical practice generally have a 70 cm bore diameter and a reconstruction field size of 50 cm.

Future interventional and robotic surgery applications will require space for access to the patient inside the bore. Room to manipulate various probes and apparatus will be necessary. The scanner may be required to exhibit excellent low contrast image quality without excessive radiation dose to the patient.

X-rays from conventional rotating anode x-ray tubes are typically emitted from the edge of the anode nearest the patient. When the gantry bore diameter is 80 cm or larger, the available space between the x-ray source and patient, normally used for beam shaping filters, is reduced or is unavailable. A reduction of size or elimination of beam shaping filters may result in higher radiation dose to the patient.

Also, the distance between the focal spot and the primary collimator is shortened. The shorter focal spot-to-collimator distance results in a more diffuse x-ray projection on the patient and the radiation detectors because of the increased penumbra. Narrow slice thickness scan options are not available and the radiation dose to the patient will be greater.

Undesirably, accommodations for these deficiencies results in physically larger CT gantries. A large bore, narrow slice, high performance CT scanner requires that the focal spot is optimally positioned with respect to the scanner's iso-center and pre-patient collimator. One consequence of moving the x-ray tube further from iso-center is an increase in the diameter of the scanner. A commercial scanner will be unable to fit through a standard hospital door. Another consequence in a fourth generation CT scanner is to require a larger and more expensive ring of detectors. Similar consequences are true of third generation CT scanners designed with large central openings.

Another detracting feature is increased off-focal radiation projection of the detectors. If not corrected, the off-focal radiation causes blurring of the reconstructed tissue near boundaries of high contrast objects. For example, brain tissue near the skull can be improperly reconstructed.

The present invention contemplates an improved method and apparatus which overcomes the above-referenced problems and others.

SUMMARY OF THE INVENTION

In accordance with one embodiment of the present invention, an x-ray tube assembly includes a housing with a vacuum envelope and an x-ray permeable exit window. An anode is positioned within the vacuum envelope oriented such that one side is nearer to the exit window than the other or far side. A cathode assembly is also positioned within the vacuum envelope which directs an electron beam toward a focal spot on the far side of the anode.

One advantage of the present invention resides in the focal spot being located further from the CT scanner's iso-center without increasing the diameter of the detector ring or increasing the size of the scanner.

Another advantage of the present invention resides in a larger diameter rotating anode usable to permit higher instantaneous x-ray loading.

Another advantage of the present invention resides in the off-focal vane restricting the view of the anode by a detector, hence the viewed off-focal contribution of the radiation from the x-ray tube is reduced.

Yet another advantage of the present invention resides in increased space within the bore of the CT apparatus.

Still another advantage of the present invention resides in the ability to position x-ray attenuating filters as close as possible to the focal spot reducing the penumbra effect.

Still another advantage of the present invention resides in the easy removal of heat generated by back scattered electrons landing on the rear wall of the tube housing.

Still further advantages of the present invention will become apparent to those of ordinary skill in the art upon reading and understanding the following detailed description.

BRIEF DESCRIPTION OF THE DRAWINGS

The invention may take physical form in certain parts and arrangements of parts and in certain steps and arrangements of steps. The drawings are only for purposes of illustrating the preferred embodiments and are not to be construed as limiting the invention.

DETAILED DESCRIPTION OF THE PREFERRED EMBODIMENTS

Figure 1:
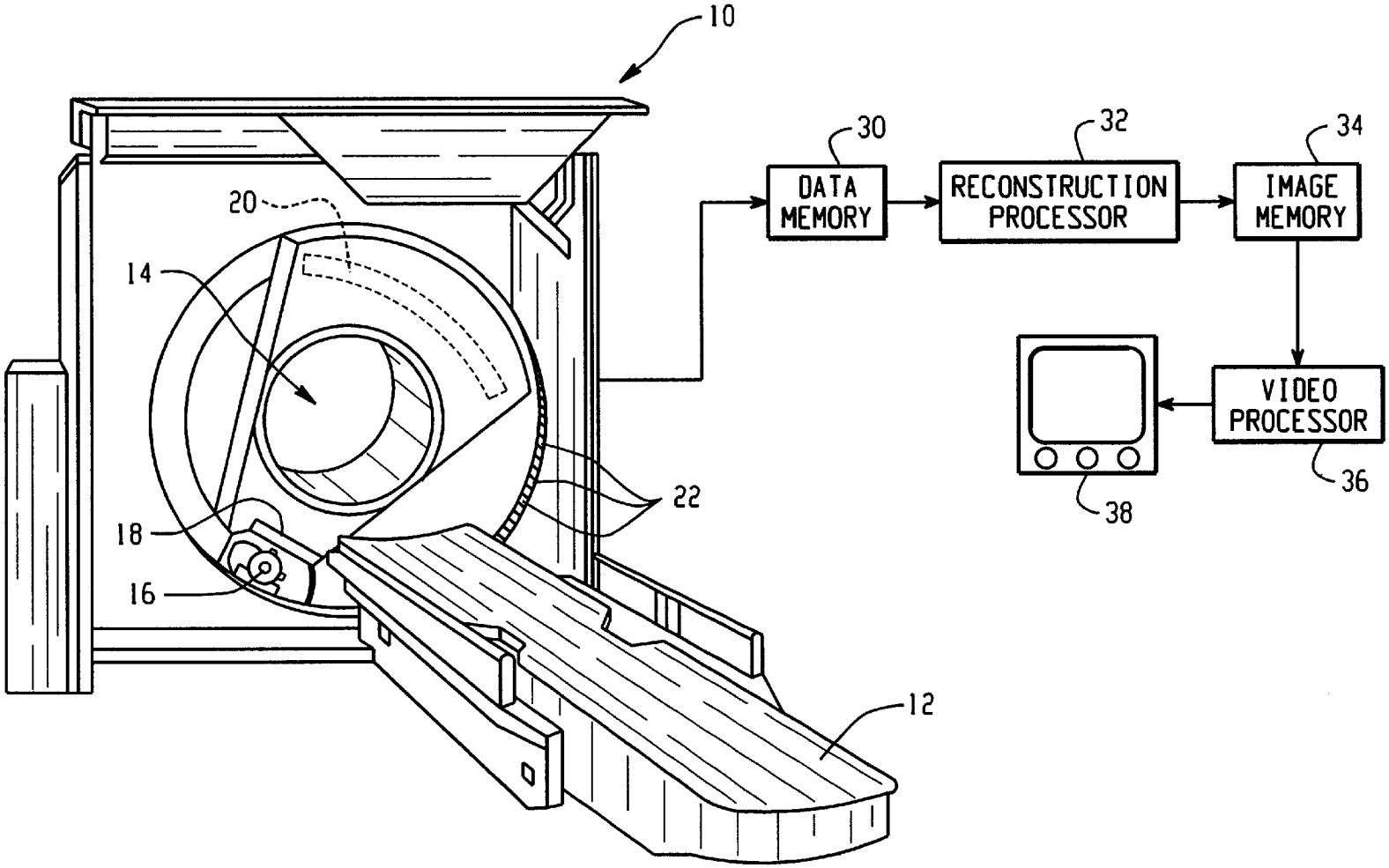
FIG. 1 is a diagrammatic illustration of a computed tomography scanner incorporating the present invention.

With reference to FIG. 1, a computerized tomography (CT) scanner 10 radiographically examines and generates diagnostic images of a subject disposed on a patient support 12. More specifically, a volume of interest of the subject on the support 12 is moved into an examination region 14 such as the enlarged region shown. An x-ray tube assembly 16 mounted on a rotating gantry projects one or more beams of radiation through the examination region 14. A collimator 18 collimates the beams of radiation in two dimensions. In third generation scanners, a two-dimensional x-ray detector 20 is disposed on the rotating gantry across the examination region 14 from the x-ray tube. In fourth generation scanners, a ring or array of two-dimensional detectors 22 are mounted on the stationary gantry around the rotating gantry.

Whether third or fourth generation, the x-ray detectors 20, 22 operate in known ways to convert x-rays that have traversed the examination region 14 into electrical signals indicative of x-ray absorption between the x-ray tube 16 and the detectors 20, 22. The electrical signals, along with information on the angular position of the rotating gantry, are communicated to a data memory 30. The data from the data memory 30 is reconstructed by a reconstruction processor 32. Various known reconstruction techniques are contemplated including spiral and multi-slice scanning techniques, convolution and back projection techniques, cone beam reconstruction techniques, and the like. The volumetric image representation generated by the reconstruction processor 32 is stored in a volumetric image memory 34. A video processor 36 withdraws selective portions of the image memory to create slice images, projection images, surface renderings, and the like and reformats them for display on a monitor 38, such as a CRT or LCD monitor.

Figure 2:
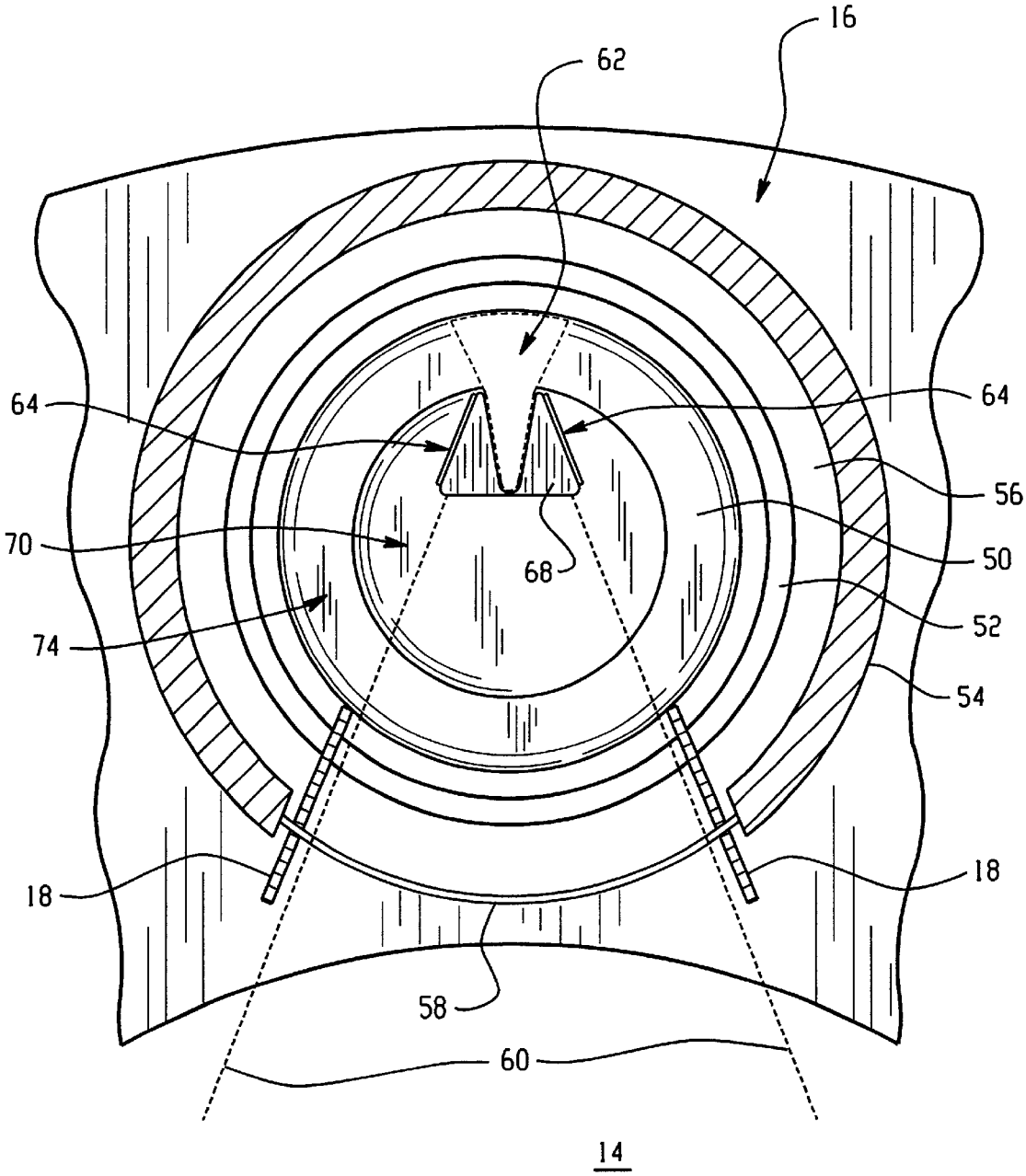
FIG. 2 is a partially cut away plan form view of an x-ray tube assembly which suitably practices the present invention; and, FIG. 3 is a cross sectional view of the x-ray tube assembly of FIG. 2.

With reference now to FIG. 2, the x-ray tube assembly 16 is positioned in the rotating gantry adjacent to the examination region 14. A disk shaped anode 50 is situated within an air evacuated housing 52. The evacuated envelope 52 is mounted in a housing 54. An oil filled cooling reservoir 56 is defined between the evacuated envelope and the cooling reservoir. The housing is lined with lead or another high-z metal with good x-ray stopping power. A window 58 of beryllium or other low-z metal or material defines an exit near the examination region 14 through which x-ray beams 60 enter the examination region 14.

The exemplary x-ray tube illustrated positions a focal spot 62 opposite of the conventional location. In other words, the focal spot is not located on the near side, or side closest to the examination region. Instead, the focal spot is located at other than the near side, for example, on the far side as illustrated. This effectively moves the apex of the fan-shaped x-ray beam 60 away from the examination region 14 roughly by the diameter of the anode, e.g. 25 cm.

Optionally, off focal vanes 64 are mounted near the focal spot 62. The vanes 64 are constructed and positioned such that the vanes 64 will not cause arcing between themselves and a cathode 66. The off focal vanes 64 are preferably stationary and may be a high-z metallic, an insulator, semiconductor and the like as long as they attenuate off focal radiation, i.e. radiation originating at other than the focal spot. This attenuation desirably decreases off angle radiation through the examination region 14 which increases patient dose and blurs the resultant image. Additionally, a shaped x-ray filter 68 is provided to modify the x-ray beam profile and reduce the radiation dose to the patient. The filter 68 can be formed from various materials, such as beryllium oxide, which is very "water-like" in composition and has excellent properties in a vacuum. The filter 68 provides substantially no attenuation near the center where the subject is typically the thickest and progressively more attenuation toward the edges of the examination region where the subject is typically thinner.

Figure 3:
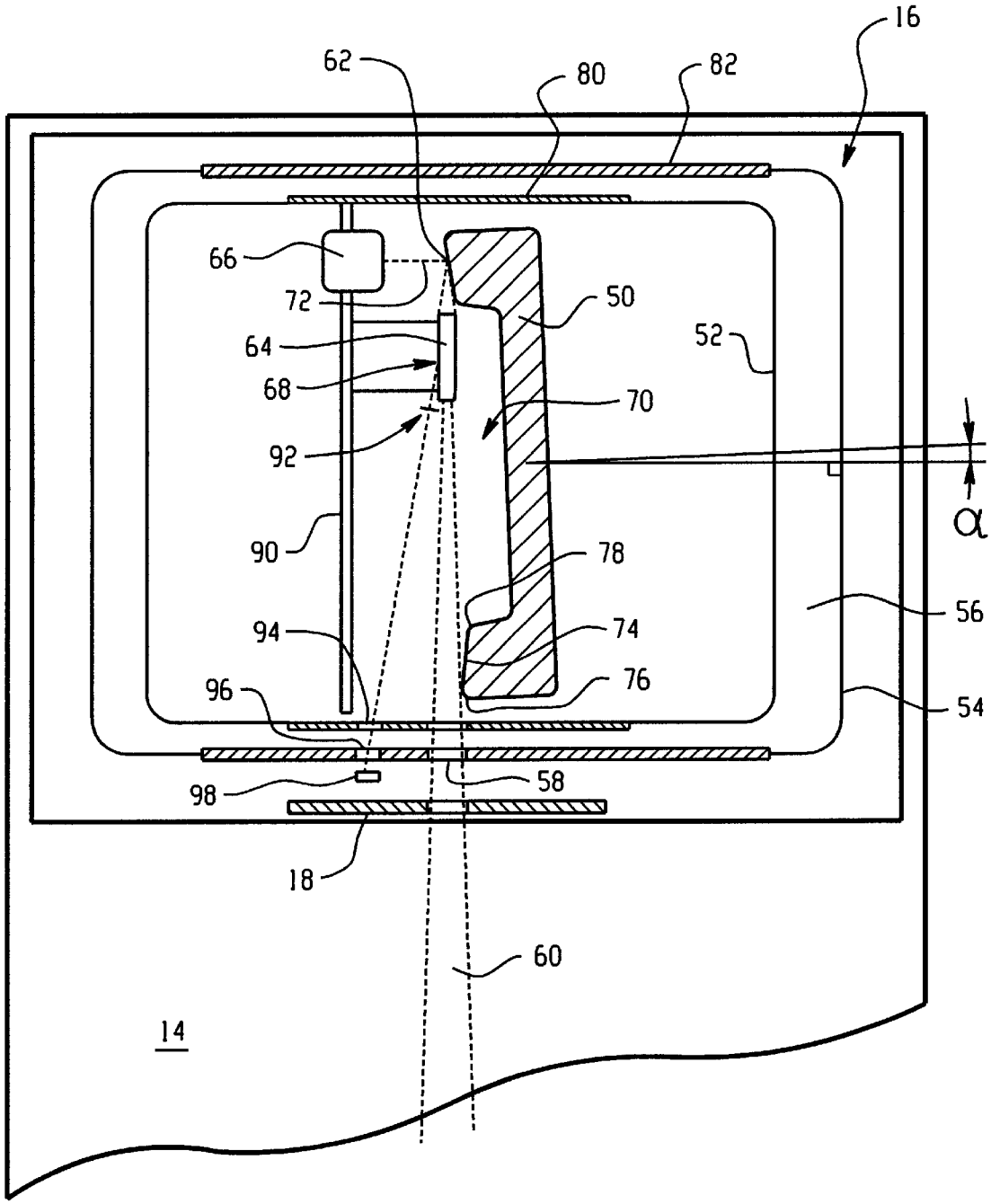

With reference now to FIG. 3, a cross section of the x-ray tube assembly 16 is illustrated. In the illustrated embodiment, the anode 50 is configured with a large cavity or indentation 70 which provides space in which to position the off focal vanes 64 and a shaped x-ray filter 68 in line between the focal point 62 and the exit window 58. The anode 50 is tilted or canted slightly within the vacuum envelope permitting x-rays emanating from the focal point 62 to pass unobstructed through the exit window 58. Additionally, this tilt desirably allows for larger diameter anodes to fit within a lower profile housing. In operation, the cathode 66 generates and focuses a stream of electrons 72 that are propelled by a high voltage toward the focal spot 62 on the anode. X-rays are generated by the interaction of the electron beam 72 and the anode 50. Certain of the x-rays generated pass between the off focal vanes 64 and filter 68, both inset slightly within the cavity 70. The x-rays then pass by the near side of the anode 50, out the exit window 58, into the imaging region 14.

The target portion 74 defines an outer periphery 76 tapering toward the geometric center of the anode 50 until reaching an inner periphery 78.

With further reference to FIG. 3, the high attenuation x-ray filters or vanes 64 are located as close to the focal spot 62 as possible. As illustrated, the x-ray filters or vanes 64 reside, at least partially, within the cavity 70 in the anode. The detectors 20, 22 (FIG. 1) view only the portion of the anode which is occluded by the filters. Any off-focal radiation that is generated at other parts of the anode does not reach the detectors.

Back-scattered electrons and a portion of the x-rays impart the back or far side wall 80. The anode 50 blocks any x-rays that are generated there from passing through itself. Lead or other high-z layers 82 protect surrounding environments from x-rays and secondary radiation. Heating of the back wall 80, generated by back-scattered electrons, can be removed by the cooling oil that is circulated in the cooling reservoir 56.

The exit window 58 is large and elongated compared to conventional x-ray tubes. It is fabricated from traditional x-ray window materials including, aluminum, titanium, beryllium or suitable plastic materials.

Situated between the focal spot 62 and the exit window 58 is a beam shaping filter 68. This shaped filter, sometimes called a compensator or bow tie filter, attenuates the x-ray beam appropriately to reduce the x-ray dose to the patient. As discussed above, an appropriate filter material is BeO.

The compensator 68 and cathode 66 may be mounted off a perforated support 90 that spans the diameter of the insert. However, there are numerous options to the depicted method of support.

The insert center section and x-ray tube housing optionally has an additional internal collimator aperture 92 and window 94 that along with a housing window 96 allows radiation to impinge upon reference detector arrays 98, that monitor the position of the x-ray focal spot 62 in two dimensions. The detector arrays 98 can be photodiodes, ion chambers or any x-ray sensitive devices usable to track and passively monitor the focal point of the electron beam or apex of the x-ray beam. The detectors 98 also provide a reference radiation intensity value.

The invention enables the use of large bore CT scanners to be used in clinical situations without sacrificing performance. The radiation dose to the patient will be equal to or lower than scanners now on the commercial market. The off-focal radiation that degrades scanner performance is highly reduced.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. An x-ray tube assembly comprising:

a vacuum envelope with an x-ray permeable exit window;

an anode positioned within the vacuum envelope having a near-side and a far-side relative to the exit window, the anode including:

a disc which defines an annular target portion, and
a central cavity located radially inward of the annular target portion;

an x-ray filter disposed within the vacuum envelope and at least partially disposed within the central cavity;

a collimator disposed within the vacuum envelope contiguous to the filter; and a cathode assembly mounted within the vacuum envelope which directs an electron beam toward a focal spot on the far side of the anode.

2. An x-ray tube assembly comprising:

a vacuum envelope with an x-ray permeable exit window;

an anode positioned within the vacuum envelope having a near-side and a far-side relative to the exit window, the anode including:

a disc which defines an annular target portion, and
a central cavity located radially inward of the annular target portion;

an x-ray beam shaping filter disposed within the vacuum envelope at least partially disposed within the central cavity; and, a cathode assembly mounted within the vacuum envelope which directs an electron beam toward a focal spot on the far side of the anode.

3. An x-ray tube assembly comprising:

a vacuum envelope with an x-ray permeable exit window;

an anode rotatably mounted within the vacuum envelope having a near-side and a far-side relative to the exit window;

a cathode assembly mounted within the vacuum envelope which directs an electron beam toward a focal spot on the far side of the anode; and an x-ray beam filter disposed between the focal spot and the exit window.

4. The x-ray tube assembly as set forth in claim 3, wherein the anode includes:

a disc with an annular target portion surrounding a central cavity.

5. The x-ray tube assembly as set forth in claim 3, wherein the anode is mounted in a tilted orientation toward the cathode.

6. The x-ray tube assembly as set forth in claim 3, wherein the anode includes:

a disc with a target portion having an outer periphery and an inner periphery, the target portion tapering toward a geometric center of the anode disc.

7. The x-ray tube assembly as set forth in claim 3, further comprising:

radiation attenuating vanes disposed between the focal spot and the exit window.

8. The x-ray tube assembly as set forth in claim 3, further comprising:

a radiation detector array positioned outside the vacuum envelope which monitors a position of the focal spot.

9. The x-ray tube assembly as set forth in claim 3, further including:

a collimator disposed between the focal spot and the exit window.

10. An x-ray tube assembly comprising:

a vacuum envelope with a first x-ray permeable exit window and a second x-ray window adjacent the first;

a radiation detector disposed adjacent the second x-ray window;

an anode positioned within the vacuum envelope having a near-side and a far-side relative to the first exit window; and a cathode assembly mounted within the vacuum envelope which directs an electron beam toward a focal spot on the far side of the anode.

11. A method of generating an x-ray beam comprising:

rotating a disc-shaped anode with a central cavity about an axis within an evacuated envelope;

generating x-rays by focusing a beam of electrons from a cathode to a focal spot of the rotating anode; and, passing generated x-rays through a radiation attenuating filter positioned between the focal spot and an exit window within the evacuated envelope.

12. The method as set forth in claim 11, further comprising:

canting the axis of the anode such that the anode rotates out of a plane defined by the focal spot and the exit window.

13. The method as set forth in claim 11, further comprising:

detecting generated x-rays; and, determining a position of the focal spot on the rotating anode.

14. The method as set forth in claim 11, further comprising:

shaping the generated x-rays into a fan shaped beam;

passing the fan shaped beam through an examination region;

receiving the fan shaped beam on a detector array which generates signals indicative of radiation received; and, reconstructing the signals into an image representation.

15. A method of generating an x-ray beam comprising:

rotating an anode which defines a central cavity about an axis within a vacuum envelope, the central cavity being radially inward of the anode;

generating x-rays by focusing a beam of electrons from a cathode to a focal spot of the rotating anode; and, filtering x-rays within the vacuum envelope between the focal spot and an exit window and at least partially within the central cavity of the anode.

16. In a CT scanner including an x-ray tube assembly mounted to a rotating gantry which selectively rotates about an examination region, a detector array which receives x-rays and generates electrical signals indicative of radiation received and a reconstruction processor which converts the electrical signals into an image representation, the x-ray tube assembly comprising:

a cathode assembly which selectively produces a stream of electrons;

a disc-shaped anode including a central cavity and a target portion radially outward from the central cavity, the target portion angling toward the central cavity; and a radiation attenuating filter at least partially within the central cavity between a focal point of the electron stream and an exit window of the x-ray tube assembly, the filter attenuating x-rays emanating from the anode.

17. The x-ray tube assembly as set forth in claim 16, further comprising:

a radiation detector which receives x-rays and monitors a position of the focal point.

18. In a CT scanner including an x-ray tube assembly mounted to a rotating gantry which selectively rotates about an examination region, a detector array which receives x-rays and generates electrical signals indicative of radiation received and a reconstruction means for converting the electrical signals into an image representation, the x-ray tube assembly comprising:

a vacuum envelope with an exit window;

a cathode assembly which selectively produces a beam of electrons;

a disc-shaped anode rotatably mounted in the vacuum envelope for connecting the electron beam into x-rays as a focal spot;

a radiation attenuating element including:

an x-ray beam shaping filter disposed in the vacuum envelope between the focal spot and the exit window which filters out a portion of the radiation passing through the filter; and, an off-focal radiation collimator located with the vacuum envelope between the focal spot and the exit window.

19. The x-ray tube assembly as set forth in claim 18, where the beam shaping filter comprises beryllium oxide.

20. The x-ray tube assembly as set forth in claim 18, where the anode includes a near-side relative to an exit window, wherein the focal spot is located on the anode at other than the near-side.

* * * * *